United States Patent [19]

Rotelli

[11] Patent Number: 4,893,769

[45] Date of Patent: Jan. 16, 1990

[54] SUPPORT FRAME FOR PLASTIC BAGS

[76] Inventor: John L. Rotelli, 706-32nd Ave., San Francisco, Calif. 94121

[21] Appl. No.: 295,010

[22] Filed: Jan. 4, 1989

Related U.S. Application Data

[63] Continuation of Ser. No. 933,865, Nov. 24, 1986, abandoned.

[51] Int. Cl.[4] ..... A63B 55/04

[52] U.S. Cl. ..... 248/97; 248/100; 248/153

[58] Field of Search ..... 248/97, 153, 100

[56] References Cited

U.S. PATENT DOCUMENTS

| | | | |
|---|---|---|---|
| 957,652 | 5/1910 | Bush | 248/97 |
| 1,895,904 | 1/1933 | Lutts | 248/97 |
| 2,470,977 | 5/1949 | Chidsey | 248/97 |
| 4,267,997 | 5/1981 | Meier | 248/153 |
| 4,467,989 | 8/1984 | Stroh | 248/99 |

FOREIGN PATENT DOCUMENTS

| | | | |
|---|---|---|---|
| 95627 | 3/1963 | Denmark | 248/97 |
| 589057 | 4/1978 | Switzerland | 248/97 |

*Primary Examiner*—Alvin C. Chin-Shue
*Attorney, Agent, or Firm*—John J. Leavitt

[57] ABSTRACT

Presented is a support frame for supporting in upright position the limp plastic film bags now being dispensed with greater regularity in retail outlets for the convenience of shoppers in carrying their purchases from the store. The limp plastic bags are closed at the bottom, open at the top and are provided with two strap-like extensions associated with the open end by which the bag may be carried or suspended. The support frame is constructed of injection molded plastic and includes a base for supporting the frame on the floor or another supporting surface such as a table, and four upright posts are provided at each corner of the base, pairs of which join at the top to provide hooks from which the bag extensions may be suspended while the bag is being filled with purchases. Cross-pieces join the pairs of posts to provide a handle suitable for gripping in the hand for lifting the frame and attached bag to facilitate moving the assembly to another more convenient location.

2 Claims, 1 Drawing Sheet

SUPPORT FRAME FOR PLASTIC BAGS

This application is a continuation of application Ser. No. 933,865, filed Nov. 24, 1986 now abandoned.

BACKGROUND OF THE INVENTION

1. Field of the Invention

This invention relates to support frames, and particularly to a support frame adapted to suspend a limp plastic bag in an upright and open condition.

2. Description of the Prior Art

The prior art related to this invention is believed to reside in Class 248, sub-classes 99 and 100.

A preliminary patentability search through this area has indicated the existence of the following U.S. Pat. Nos. 4,366,916, 4,467,989, 4,418,835, 4,407,474 4,175,602 4,437,634 4,363,405 4,445,658.

While all of the patents noted above relate to devices of one sort or another for supporting a plastic bag, perhaps the most pertinent of the patents is U.S. Pat. No. 4,467,989 which discloses a collapsible wire frame for supporting the same type of limp plastic bag sought to be supported by the support frame forming the subject matter of this invention. However, it is to be noted that the wire frame disclosed in U.S. Pat. No. 4,467,989 is a composite structure made up of many parts that require careful assembly, resulting in an inordinate cost to the consumer. By comparison, the support rack of the instant invention is injection molded from a tough synthetic resinous material in one operation to provide a monolithic frame that is impervious to moisture, can be easily wiped clean, and which will not corrode when subjected to moisture.

Accordingly, it is one of the objects of the invention to provide a support frame for a limp plastic bag of the type having two suspensory members, which support frame is constructed of a single unit by injection molding of synthetic resinous material, more commonly known as "plastic".

Another object of the invention is the provision in such a plastic support frame of means for locking the suspensory members of the limp plastic bag to the support frame in a manner to retain the plastic bag in an upright attitude with the open end thereof maintained in open condition for the reception of articles to be deposited inside the plastic bag.

Still another object of the invention is the provision of a support frame of unitary construction on which a limp plastic bag may be suspended for filling, and which admits of the ready removal of the filled bag from the support frame.

It is sometimes necessary to move a filled plastic bag of the type contemplated by this invention from one location to another. Accordingly, it is another object of the invention to provide a unitary plastic support frame for a limp plastic bag that provides handles which may be grasped while the bag is still attached to the frame so that the frame and attached bag may be lifted and moved to another location without concern that the bag will separate from the frame.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the plastic bag support frame of the invention comprises an injection molded, unitary structure which includes a quadrilateral base member from the four corners of which extend generally parallel flexible upright members or posts having a height substantially equal to the height of the bag to be supported. On each end of the frame, two of the posts, constituting a pair of posts, define a flexible side member, and are provided with reentrant portions that extend from the inner face of the flexible side member toward the opposite and complimentary pair of posts forming the other flexible side member at the opposite end of the frame. The reentrant portions are provided with downwardly extending U-shape recesses or shallow hooks adapted to receive and retain the suspensory members of the plastic bag, while adjacent end portions of the reentrant portions are integrally connected by elongated handle members adapted to facilitate grasping the frame in the hand and lifting the frame and bag to move it to a different location.

DESCRIPTION OF THE PREFERRED EMBODIMENT

Figure 1:
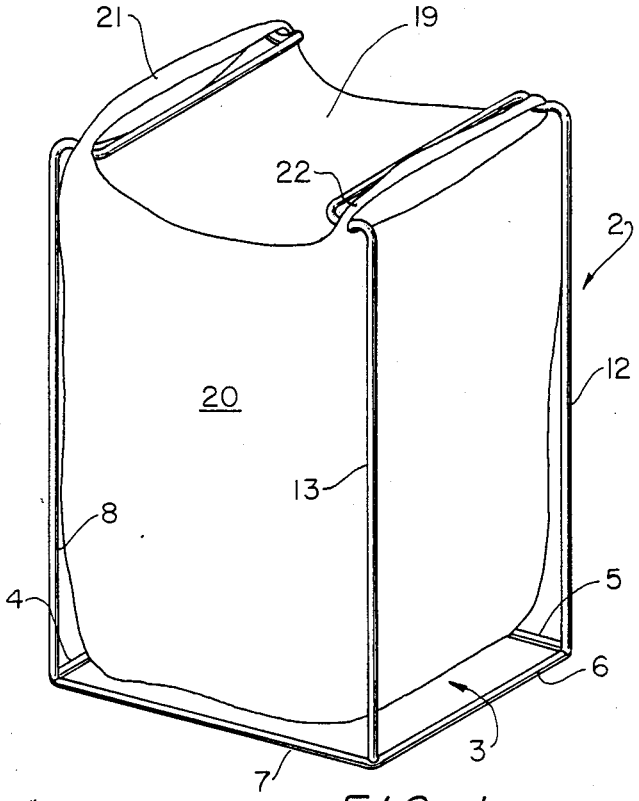
FIG. 1 is a perspective view illustrating the support frame of the invention with limp plastic bag attached and supported thereon.
Figure 2:
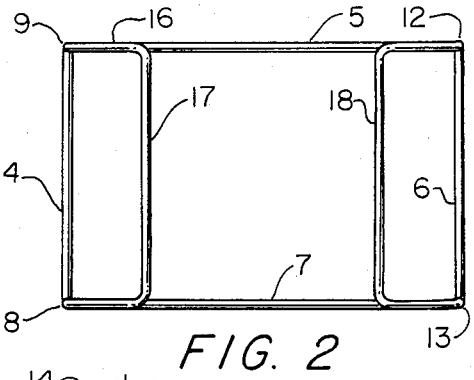
FIG. 2 is a top plan view.

In terms of greater detail, the unitary support frame of the invention is designated generally by the numeral 2, and includes a base member 3 formed from four integrally joined members 4, 5, 6, and 7, arranged in a generally quadrilateral configuration, all the integrally joined members forming the base lying in a common plane so as to provide a wide and inherently stable base for the support frame.

Where the ends of the base members 4, 5, 6 and 7 join integrally to form a strong union, there being four such unions at the four corners of the base, rise vertically extending posts or upright members 8, 9, 12, and 13, formed from the same type of plastic material as the base members, and joined integrally thereto at the respectively associated unions. Thus, referring to FIG. 1, the union of base members 4 and 7 is also joined integrally by the upright member or post 8, while the post 9 joins integrally with the union of the base members 4 and 5. In like manner the post 12 joins the union of base members 5 and 6, while the post 13 joins the union of base members 6 and 7. There is thus formed an open framework of integrally connected unitary members that not only provide the strength required to support a plastic bag filled with purchases (or kitchen refuse), but also provides a framework having a controlled degree of resilience so that the post members may be manipulated for different purposes as will hereinafter be apparent.

Again referring to FIG. 1, it will be seen that posts 8 and 9 constitute a pair of posts on one side of the base, while posts 12 and 13 constitute another pair on the opposite side of the base. The pair of posts 8–9 lie in a common vertical plane that is generally perpendicular to the plane in which the base members lie, and form a flexible side member having an inner and outer face. In the same manner, the pair of posts 12–13 lie in a common vertical plane that is generally perpendicular to the plane in which the base members lie, and also form a flexible side member having an inner and outer face. Thus, the two pairs of posts 8–9 and 12–13 lie substantially parallel to each other, with the corresponding posts 8 and 13 of opposed pairs of posts also included in a common vertical plane that is generally perpendicular to the plane which contains the pairs of posts 8 9 and 12–13. In like manner, the corresponding posts 9 and 12 of opposed pairs of posts are also included in a common vertical plane perpendicular to the planes containing the pairs of posts 8–9 and 12–13, and perpendicular also to the plane containing the base members.

Figure 3:
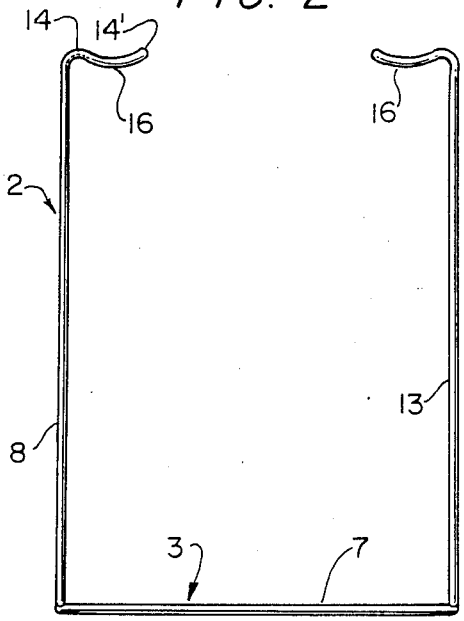
FIG. 3 is a side elevational view.
Figure 4:
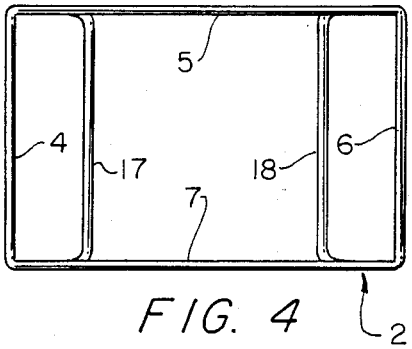
FIG. 4 is a bottom plan view.

Referring to the side view illustrated in FIG. 3, it will there be seen that the post 8 at its upper end remote from its union with the base members 4 and 7 is provided with an inwardly projecting integral extension 14 lying generally perpendicular to the post from which it extends and thus lying generally parallel with the base member 7. At a point remote from the post 8, the extension dips downwardly to provide a smoothly concave or shallow U-shaped section 16 that lies below extension 14, thus forming a hook or seat for purposes which will become apparent hereinafter. On the far side of the concave section 16, the extension continues in extension portion 14' which again rises to the level of extension 14, thus clearly defining the concave section as a recess or hook or seat within which something may be seated and retained against movement in a direction parallel to the extension 14.

Each of the other posts 9, 12 and 13 are each provided with the same type of extension and concave section, and in the interest of brevity in this description, these similar structures will not be described in detail.

To complete the unitary framework, the remote extensions 14' extending from posts 8 and 9 are connected integrally by a cross-piece 17 which thus joins the upper ends of the posts 8 and 9 to form a generally rectangular end frame the top of which is formed by the cross-piece 17, the bottom by base member 4 and the sides by posts 8 and 9. However, it will be seen that the top cross-piece 17 is not in the plane of the posts 8 and 9 or the base member 4, but lies inwardly of the plane of the posts 8 and 9 by the cumulative lengths of the extension 14, downwardly extending hook portion 16, and extension portion 14', to thus place the cross-piece 17 inboard from the plane of the posts 8 and 9.

Again, in the interest of brevity in this description, the posts 12 and 13 and the horizontal extensions thereof corresponding to the extensions 14, 16, and 14', are also connected by an integral cross-piece 18 that lies in the same relative position to the posts 12 and 13 as does the cross-piece 17 to the posts 8 and 9. Thus, the two cross-pieces 17 and 18 lie in a common horizontal plane parallel to the plane in which lie the base members 4, 5, 6 and 7, but are spaced apart to provide an opening 19 therebetween through which a limp plastic bag 20 may be introduced for suspension on the framework. In this regard, the limp plastic bag is provided with a body that lies within the framework, and strap-like handles 21 that join integrally with the body of the bag adjacent the open end thereof. Apart from the framework forming the subject matter of this invention, the strap-like handles may be grasped in the hand and the bag carried about very conveniently, even when loaded with substantially heavy objects. It is surprising how strong these bags are, and the amount of weight they will support.

When used in conjunction with the framework 2, one of the two strap-like handles 21 is draped over and engaged in the concave extension portions 16 associated with posts 8 and 9, while the other strap-like handle 22 is similarly draped over and engaged in the concave extension portions associated with the posts 12 and 13. It will thus be seen that the open end of the bag is retained open because engagement of the strap-like handles in the manner described holds the bag open, and the limp body of the plastic bag is supported in the an upright attitude as illustrated in FIG. 1, thus enabling numerous objects, including kitchen refuse, to be deposited in the open end of the bag. Ideally, the length of the post pairs 8–9 and 12–13 is such that when the bag is attached as described and illustrated, the bottom of the bag will rest on the same surface that the base 3 rests on, thus relieving the posts 8, 9, 12 and 13 from supporting the weight of the contents of the bag.

It has been discovered that the flexibility of the post pairs 8–9 and 12–13 is particularly advantageous for at least two reasons. On the one hand, when the bag has been filled with objects, whether they be groceries at the grocery store, or kitchen refuse, the bag will tend to bulge to its greatest girth. It has been found that even such an expanded bag may be easily extricated from the framework merely by flexing the post pairs outwardly after disengaging and removing the strap-like handles 21 and 22 from their respective hook-like support members 16.

Figure 6:
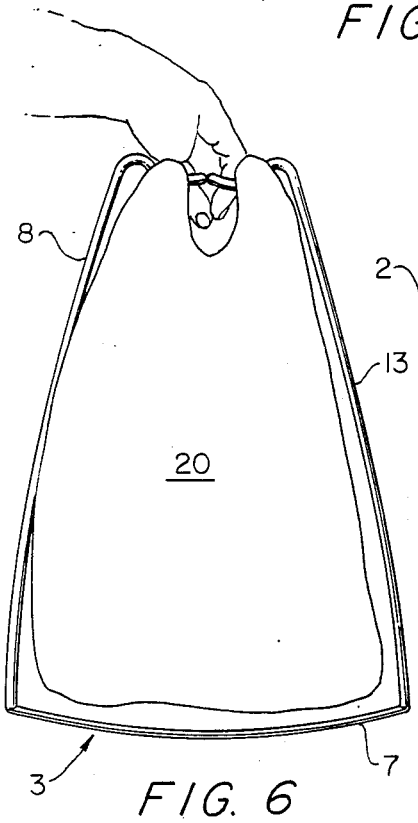
FIG. 6 is a side elevational view of the support frame with a plastic bag supported thereon, and the opposite end members grasped and pulled together to form a handle by which the support frame and bag may be lifted and moved from one place to another.
Figure 5:
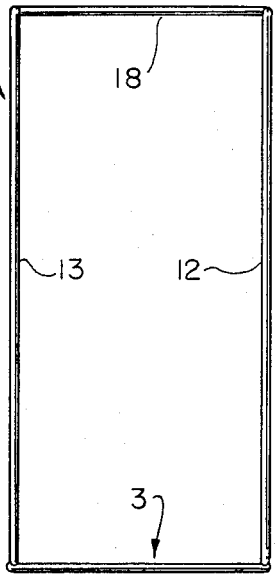
FIG. 5 is an end elevational view.

On the other hand, should it be more convenient, or give greater confidence in the strength of the union between the strap-like members 21 and 22 with the body of the bag to pick up the entire framework 2, with the bag attached, the two crosspieces 17 and 18 may be moved inwardly as shown in FIG. 6, so that the two cross-pieces may be grasped in the hand and the entire assembly picked up and carried to another location. To accomplish this, the post pairs 8–9 and 12–13 flex inwardly toward each other as shown, but then spring back because of inherent resilience when the cross-pieces are released.

Having thus described the invention, what is believed to be new and novel and sought to be protected by letters patent of the United States is as follows:

I claim:

1. A support frame with limp plastic bags having strap like hand-grips, comprising:

(a) a unitary base quadrilateral in its configuration and formed from four integral rod-like members lying in a common horizontal plane;

(b) a pair of flexible upright side members extending vertically upwardly from two opposite sides of said unitary base, each side member formed from a pair of perpendicularly extending posts lying in a common plane and having an upper end and a lower end and being integrally attached at the lower end to said base, each side member defining an outer face and an inner face the inner face of one side member being opposed to the inner face of the other side member and parallel therewith when upright;

(c) horizontal inwardly extending hook means having inner and outer ends and shallow U-shaped middle sections, the outer ends being integral with the upper ends of corresponding flexible side members and lying inside the plane in which the corresponding said side members lie said hook means receiving, positioning and retaining in an open position said limp plastic bag with said hand-grips removably draped in said U-shaped middle sections of said hook means, whereby said plastic bag is suspended over said base and between said side members; and (d) a pair of elongated generally parallel handles lying in a common horizontal plane, each handle being integral with the inner ends of the hook means formed on corresponding side members, and proximate the upper end of each side member, each handle being spaced laterally inwardly from said hook means and toward the other handle from the inner face of its corresponding side member whereby the handles lie inside said hook means and thus inside the hand-grips of a plastic bag draped in said U-shaped middle sections of said hook means, said flexible side members being sufficiently flexible that upon grasping of said handles the upper ends of said flexible side members are displaced toward each other, thereby simultaneously closing the opening of the limp plastic bag for transportation purposes.

2. A support frame for plastic bags as described in claim 1, which is integrally fabricated from plastic rod.

* * * * *